United States Patent [19]

Curtis, Sr.

[11] Patent Number: 4,674,295

[45] Date of Patent: Jun. 23, 1987

[54] EVAPORATIVE AIR CONDITIONER AND METHOD

[76] Inventor: Thad C. Curtis, Sr., 5820 S. Hopdown La., Tucson, Ariz. 85746

[21] Appl. No.: 690,768

[22] Filed: Jan. 11, 1985

Related U.S. Application Data

[63] Continuation of Ser. No. 475,339, Mar. 14, 1983, abandoned.

[51] Int. Cl.[4] ..... F25D 17/04

[52] U.S. Cl. ..... 62/309; 62/304; 261/94

[58] Field of Search ..... 62/304, 309, 310, 311; 261/106, 94, DIG. 72; 165/60

[56] References Cited

U.S. PATENT DOCUMENTS

| | | | |
|---|---|---|---|
| 1,721,589 | 7/1929 | Donaldson | 165/60 |
| 1,966,275 | 6/1934 | Wright | 62/11 X |
| 2,044,352 | 6/1936 | Evans | 62/310 |
| 4,003,212 | 1/1977 | Kinsell et al. | 62/309 X |
| 4,231,975 | 11/1980 | Peltier | 261/106 |

*Primary Examiner*—Henry Bennett

*Attorney, Agent, or Firm*—Harry M. Weiss & Associates

[57] ABSTRACT

An efficient, low operating cost evaporative air conditioner is disclosed. Low cost cooling is achieved without increasing the relative humidity of the air being cooled. The air conditioner includes a plurality of hollow heat exchange tubes through which is forced the air to be cooled. The exteriors of the heat exchange tubes, and thus the air passing through the tubes, is cooled by evaporative cooling. The evaporative cooling can be effected, for example, by blowing moist air across the exteriors of the tubes.

11 Claims, 4 Drawing Figures

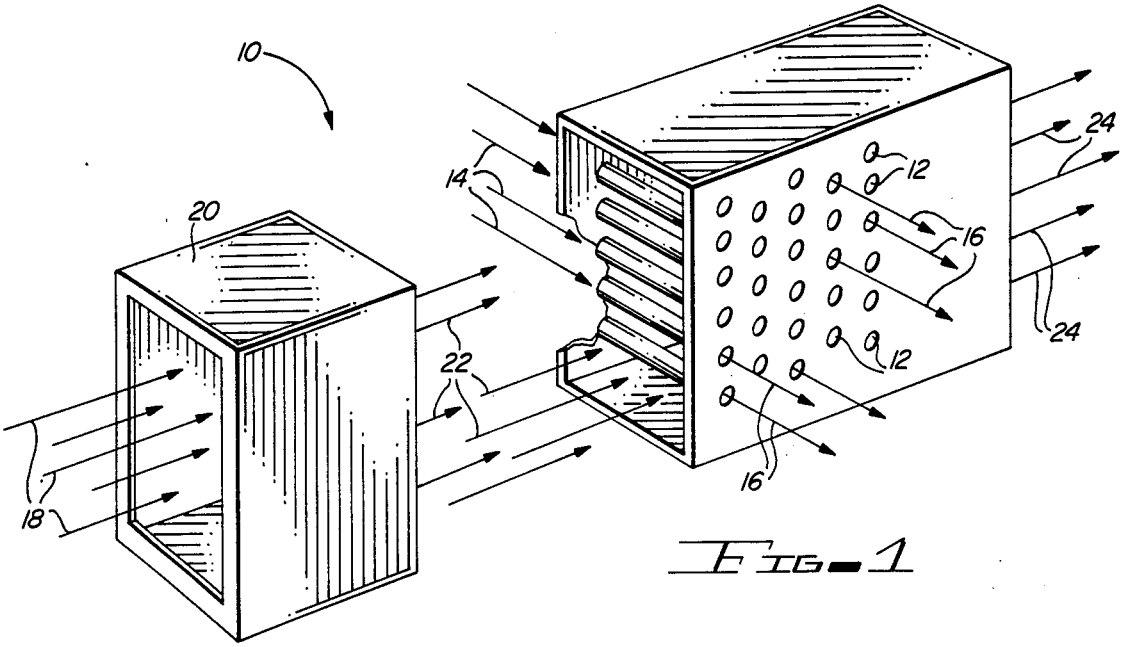
FIG-1
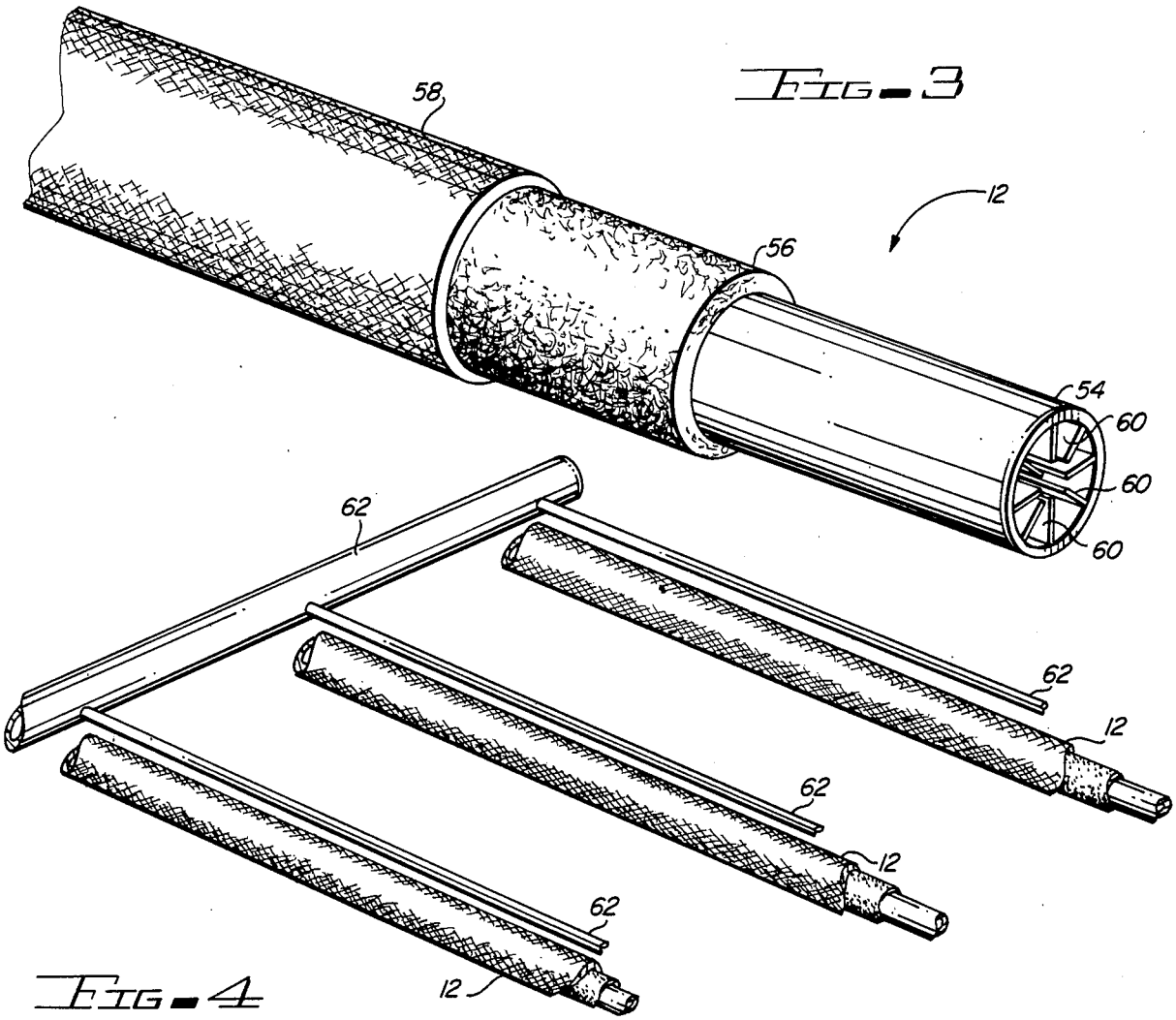
FIG-3
FIG-4

EVAPORATIVE AIR CONDITIONER AND METHOD

This is a continuation of application Ser. No. 475,339, filed Mar. 14, 1983, now abandoned.

BACKGROUND OF THE INVENTION

1. Field of the Invention

This invention relates generally to an air conditioner and method for cooling air, and, more particularly, to an evaporative air conditioner and related method.

2. Description of the Prior Art

In the prior art there are two primary types of air conditioners or air coolers, refrigerative air conditioners and evaporative coolers. The refrigerative air conditioner uses a compressible medium such as ammonia or one of a number of fluorocarbons or chlorofluorocarbons which is sequentially compressed and expanded to provide a cooling function. Such air conditioners are generally expensive, as they require a costly compressor, condenser, and the like. They are also expensive to operate because the compressor requires the expenditure of a large amount of energy, usually electricity.

Evaporative coolers, in contrast, are generally less expensive, both in initial capital expenditure and in operating cost. An evaporative cooler forces outside air through moist pads and then into the building to be cooled. Cooling of the air results from evaporation of the water from the pads. Evaporative coolers have the disadvantage, however, that the cooling results in an increase in the humidity within the building. The increased humidity may lower the comfort factor within the building even though the temperature is lowered.

In view of the disadvantages of prior art air conditioners and coolers, it is an object of this invention to provide an improved air conditioner which is economical and efficient.

It is a further object of this invention to provide an improved air conditioner which does not raise the humidity of the air being cooled.

It is a still further object of this invention to provide an improved method for cooling air.

BRIEF SUMMARY OF THE INVENTION

The foregoing and other objects and advantages are achieved through the evaporative air conditioner and its use as herein described. The evaporative air conditioner, in one embodiment, includes a number of hollow heat exchange tubes through which is forced air from the building to be cooled. The exterior surface of the heat exchange tubes is cooled by evaporative cooling and thus the air passing through the interior of the tubes is cooled. The air cooled by passage through the heat exchange tubes is returned to the building; this air is isolated, during the cooling, from the evaporative cooling process and it thus does not experience an increase in humidity.

BRIEF DESCRIPTION OF THE DRAWINGS

FIG. 1 illustrates schematically the operation of one embodiment of the evaporative air conditioner;

FIG. 3 illustrates one embodiment of a heat exchange means; and

FIG. 4 illustrates a further embodiment of evaporative cooling means.

DETAILED DESCRIPTION OF THE DRAWINGS

Figure 2:
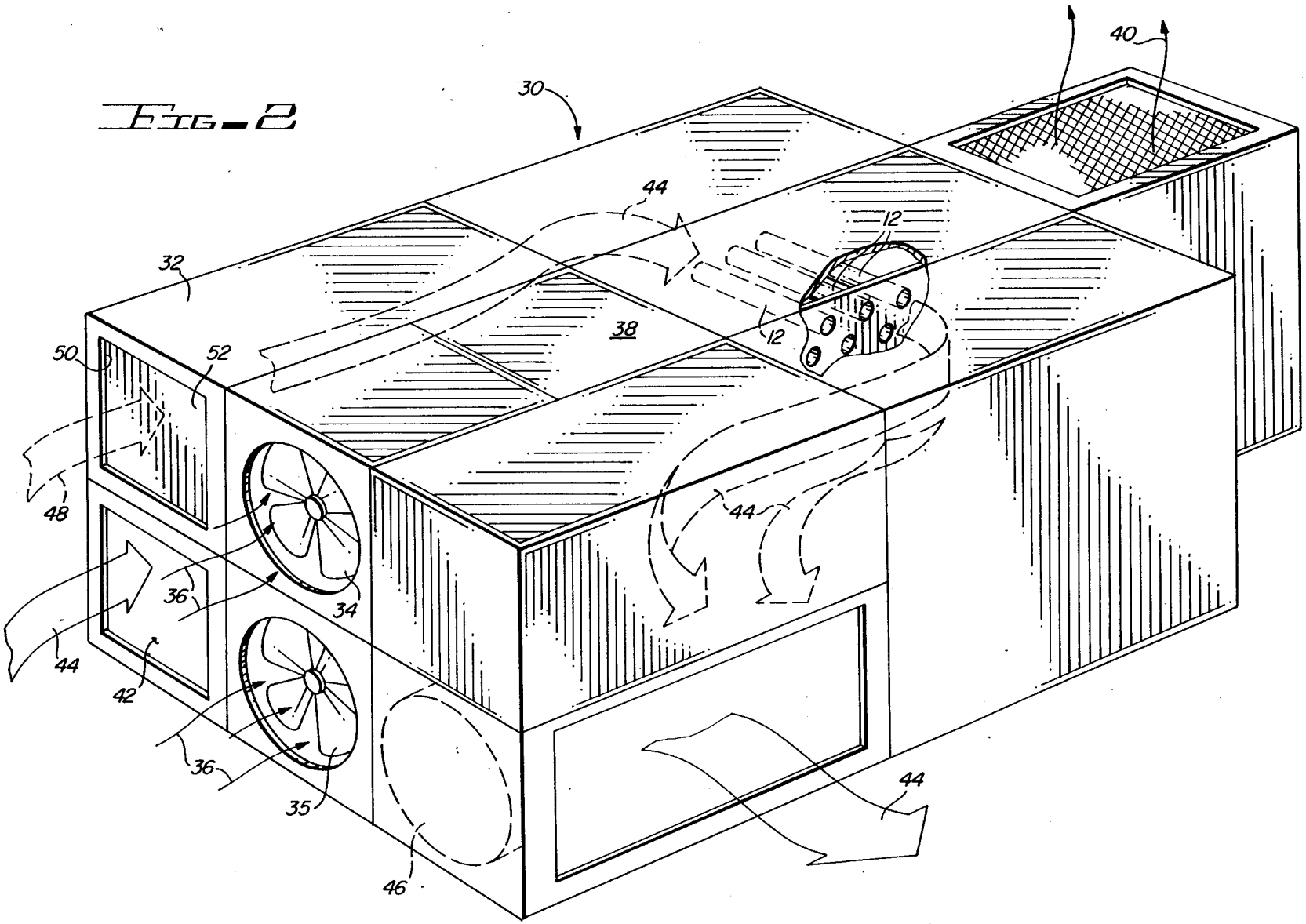
FIG. 2 illustrates one embodiment of the invention.

FIG. 1 illustrates schematically one embodiment of an evaporative air conditioner 10, in accordance with the invention. Air conditioner 10 includes a plurality of hollow heat exchange means 12 through which a body of air from the building to be cooled, indicated by the arrows 14, can be directed. The exterior surface of the hollow heat exchange means is cooled by evaporative cooling. This, in turn, cools the body of air from the building when it passes through the interior of the heat exchange means 12. Cooled air exiting from the heat exchange means, indicated by the arrows 16, is returned to the building.

In this embodiment of the invention, evaporative cooling is accomplished by forcing outside air 18 through a mister 20 or other means for saturating air 18 with an evaporable fluid. In one specific embodiment, mister 20 provides a fine mist or spray of water through which air 18 passes. The air is saturated with water or, at least, the water content of the air is increased. Other evaporable fluids can be employed, but water is a preferred fluid because of its low cost. Saturated water 22 from the mister 20 passes over the exterior of the hollow heat exchange means 12 causing the exterior to be cooled by evaporation of the evaporable fluid. Exhaust air 24, after passing over the heat exchange means 12 can be returned to the outside or used for other evaporative cooling, as desired.

FIG. 2 illustrates, more completely, an evaporative air conditioner 30 in accordance with one embodiment of the invention. Conditioner 30 can be constructed with an enclosing shell 32 of, for example, sheet metal or sheet fiberglass.

In this embodiment, the evaporative cooling means includes two high volume fans 34 and 35 which draw outside air 36 into the conditioner. The two fans provide variable levels of cooling as further explained below. Outside air, driven by fans 34, 35, is moistened with water by mister 38. A single mister 38 can increase the water vapor content of the air driven by both fans, or, preferably, two separate misters can each supply a mist of water, one for the air driven by each of the fans. After passing through the mister, the air from each fan is directed across the exterior surfaces of a plurality of heat exchange tubes 12. Preferably the heat exchange tubes are arranged in upper and lower arrays, with the air from each fan directed across one of the arrays. The moist air passing over the heat exchange tubes is cooled by evaporation of the water carried by the air and, in turn, lowers the temperature of the tubes by evaporative cooling. After cooling the heat exchange tubes, the air 40 is exhausted from the apparatus. This exhaust air, still high in moisture content, can be used, for example, for cooling an attic or other portion of the building where humidity is not an important factor, or can be simply exhausted back to the outside air.

Evaporative air conditioner 30 also includes an air inlet 42 through which a body of air from the interior of the building to be cooled enters the conditioner. Duct work or the like (not shown) conveys the air from the building to inlet 42. The body of air passes through the interior of the hollow heat exchange tubes 12 where it is cooled and then is forced by a circulation blower 46 such as a "squirrel cage" fan back to the building. Passage of the body of air through the air conditioner is indicated by the sequence of arrows 44.

As an alternative, fresh air, rather than a body of air from the building, can be cooled and then returned to the building. Fresh air, indicated by the arrow 48, enters the air conditioner through a fresh air inlet 50. A flap 52 can be selectively positioned to cover either the fresh air inlet 50 (as shown) or the building air inlet 42 to select building air or fresh air, respectively or the flap 52 may be completely removed. Also, both of the inlets 42 and 50 may be blocked by two flaps 52 if desired.

FIG. 3 illustrates one embodiment of a portion of a hollow heat exchange means 12. In this embodiment the heat exchange means comprises a hollow tube 54 such as a tube of aluminum or other heat conductive material. Surrounding the tube 54 is a thin layer 56 of Portland-type cement, or the like. Thin layer 56 provides mass and acts as a heat sink. Thin layer 56 may further be covered by a layer 58 of a burlap-type material or the like, to further aid in the cooling. To enhance the heat exchange, that is, the removal of heat from the air passing through heat exchange means 12, the interior of tube 54 is preferably provided with a plurality of heat exchange fins 60. The heat exchange fins increase the heat conducting surface area of the interior of heat exchange means 12 which is contacted by air passing there through. The heat exchange fins are in thermal contact with tube 54 and can be an aluminum whisker brush, aluminum foil, radial metal fins, or the like.

FIG. 4 illustrates a further embodiment of the invention, and particularly of the means for evaporative cooling the exterior of the heat exchange means. Illustrated in FIG. 4 is a portion of the array of heat exchange means 12. Positioned over each of the means 12 is a perforated drip tube 62 which can controllably drip an evaporable fluid, preferably water, onto the heat exchange means below. The plurality of drip tubes 62 is fed by a central manifold 64. In this embodiment, the system of drip tubes takes the place of the mister. This embodiment is particularly useful when the heat exchange means includes tubes covered with a burlap-like fabric. The fabric is wet by the drip system and evaporation, and thus cooling, occurs when outside air is forced past the tubes.

With reference again to FIG. 2, the evaporative air conditioner is operated, in accordance with the invention, as follows. The circulation blower 46 draws air from the building or draws fresh air from outside, depending on the position of flap 52. However, air may be drawn from both inside and outside the building by removing the flap 52. This air passes through the heat exchange means 12 and is returned to the building. The amount of cooling of this air is governed by the operation of fans 34, 35. If neither fan is operated, no cooling takes place and the apparatus serves merely to circulate air. Maximum cooling is achieved by operating both fans and by operating evaporative cooling means such as a mister with each fan. An intermediate amount of cooling is achieved by operating only one of the fans. Thermostatic means can be connected to the evaporative air conditioner, in conventional manner, to regulate the amount of cooling provided and to maintain a desired temperature within the building.

Thus it is apparent that there has been provided, in accordance with the invention, an evaporative air conditioner and a cooling method which fully meet the objects and advantages set forth above. The air conditioner provides low cost, efficient cooling without increasing the humidity in the air being cooled. While the invention has been illustrated and described with respect to certain illustrative embodiments, it is not intended that the invention be limited to those embodiments. Those skilled in the art will appreciate, after review of the foregoing description, that certain variations and modifications in those embodiments are possible without departing from the spirit of the invention. Accordingly, it is intended to include within the invention all such variations and modifications as fall within the appended claims.

What is claimed is:

1. A method for cooling a body of air to be exhausted into a building which comprises the steps of:

providing a plurality of hollow heat exchange tubes;

covering each of said tubes with inner cover means for providing mass and for acting as a heat sink;

covering each of said inner cover means with a porous outer cover;

said inner cover means having a higher heat retension value than said outer cover means;

injecting an evaporable fluid into a first quantity of outside air, said step of injecting comprises forming a mist of said evaporable fluid and passing said first quantity of outside air through said mist;

forcing said first quantity of outside air past each porous outer cover each of said inner cover means and the exterior of each of said plurality of hollow heat exchange tubes; and forcing said body of air through the interior of said tubes, said body of air including at least one of a second quantity of outside air and a quantity of air from said building.

2. The method of claim 1 wherein said step of injecting comprises dripping said evaporable liquid onto said plurality hollow heat exchange tubes.

3. An evaporative air conditioner for cooling a first body of air and exhausting said first body of air into an enclosure such as a building, comprising:

a plurality of hollow heat exchange means, said plurality of hollow heat exchange means comprises: (a) a plurality of hollow metal pipes, and (b) heat exchange fins attached inside said hollow metal pipes;

means for covering said plurality of hollow heat exchange means, said covering means including a plurality of inner cover means and a plurality of outer cover means, said plurality of inner cover means being operably disposed between said plurality of heat exchange means and said plurality of outer cover means, said plurality of inner and outer cover means for cooling said first body of air, said plurality of inner cover means for providing mass and for acting as a heat sink, said plurality of inner cover means are made of a cement material, and said plurality of outer cover means are made of a porous burlaptype fabric;

means for adding evaporable moisture to a second body of air;

means for directing said first body of air through the interior of said plurality of hollow heat exchange means, said first body of air including at least one of a third body of air from outside said evaporative air conditioner entering said air conditioner through a second inlet, said first and second inlets including means for selectively blocking one of (a) none of said inlets, (b) one of said inlets and (c) both of said inlets;

means for passing said second body of air around said plurality of hollow heat exchange means and said pluralities of inner and outer cover means, said second body of air evaporatively cooling the exterior of said plurality of heat exchange means and cooling said first body of air passing through said plurality of heat exchange means, said second body of air exiting said evaporative air conditioner through an exhaust exit; and means for exhausting said first body of air out of said evaporative air conditioner and into said enclosure.

4. An evaporative air conditioner for cooling a first body of air and exhausting said first body of air into an enclosure such as a building, comprising:

a plurality of hollow heat exhange means;

means for covering said plurality of hollow heat exchange means, said covering means including a plurality of inner cover means and a plurality of outer cover means, said plurality of inner cover means having a higher heat retention value than said plurality of outer cover means and being operably disposed between said plurality of heat exchange means and said plurality of outer cover means, said plurality of inner and outer cover means for cooling said first body of air, said plurality of inner cover means for providing mass and for acting as a heat sink;

means for adding evaporable moisture to a second body of air;

means for directing said first body of air through a first inlet into the interior of said plurality of hollow heat exchange means, said first body of air including at least one of a third body of air from outside said evaporative air conditioner entering said air conditioner through a second inlet, said first and second inlets including means for selectively blocking one of (a) none of said inlets, (b) one of said inlets and (c) both of said inlets, said third body of air comprises a portion of the ambient air outside said building and said means for exhausting said first body of air out of said evaporative air conditioner and into said building comprises one of a fan and blower;

means for passing said second body of air around said plurality of hollow heat exchange means and said pluralities of inner and outer cover means, said second body of air evaporatively cooling the exterior of said plurality of heat exchange means and cooling said first body of air passing through said plurality of heat exchange means, said second body of air exiting said evaporative air conditioner through an exhaust exit;

means for exhausting said first body of air out of said evaporative air conditioner and into said enclosure; and a fourth body of air which comprises a portion of the ambient air within said building.

5. The evaporative air conditioner of claim 4 wherein said means for passing said second body of air around said pluralities of inner and outer cover means comprises one of a fan and blower.

6. The evaporative air conditioner of claim 5 wherein said plurality of hollow heat exchange means comprises a plurality of hollow metal pipes.

7. The evaporative air conditioner of claim 6 wherein said plurality of hollow heat exchange means further comprises heat exchange fins attached inside said hollow metal pipes.

8. The evaporative air conditioner of claim 7 wherein said plurality of inner cover means are made of a cement material.

9. The evaporative air conditioner of claim 8 wherein said outer cover means are made of a porous burlap-type fabric.

10. The evaporative air conditioner of claim 9 wherein said means for adding evaporative moisture to a second body of air comprises a mister for injecting a water mist into said second body of air.

11. The evaporative air conditioner of claim 9 wherein said means for adding evaporable moisture to a second body of air comprises:

a plurality of perforatial tubes positioned above said plurality of hollow heat exchange means; and evaporable moisture supply means connected to said perforated tubes for causing evaporable moisture to drip from said perforated tubes onto said hollow heat exchange means.

* * * * *